US012207731B2

(12) United States Patent
Yang et al.

(10) Patent No.: US 12,207,731 B2
(45) Date of Patent: Jan. 28, 2025

(54) SOFA SEAT STRETCHING DEVICE

(71) Applicant: DEWERTOKIN TECHNOLOGY GROUP CO., LTD., Zhejiang (CN)

(72) Inventors: Liming Yang, Zhejiang (CN); Qiqi Ye, Zhejiang (CN); Bin Shen, Zhejiang (CN); Kangming Tao, Zhejiang (CN); Hanhao Tu, Zhejiang (CN)

(73) Assignee: DEWERTOKIN TECHNOLOGY GROUP CO., LTD., Zhejiang (CN)

( * ) Notice: Subject to any disclaimer, the term of this patent is extended or adjusted under 35 U.S.C. 154(b) by 0 days.

(21) Appl. No.: 17/770,847

(22) PCT Filed: Nov. 16, 2021

(86) PCT No.: PCT/CN2021/130788

§ 371 (c)(1),
(2) Date: Apr. 13, 2023

(87) PCT Pub. No.: WO2023/056686

PCT Pub. Date: Apr. 13, 2023

(65) Prior Publication Data

US 2024/0138577 A1 May 2, 2024

(30) Foreign Application Priority Data

Oct. 8, 2021 (CN) ..... 202111170623.X
Oct. 8, 2021 (CN) ..... 202122414443.3

(51) Int. Cl.
*A47C 1/0355* (2013.01)
*A47C 1/032* (2006.01)
*A47C 17/16* (2006.01)

(52) U.S. Cl.
CPC ..... *A47C 1/0355* (2013.01); *A47C 1/03211* (2013.01); *A47C 1/0347* (2013.01); *A47C 17/163* (2013.01)

(58) Field of Classification Search
CPC ..... A47C 1/0355
See application file for complete search history.

(56) References Cited

U.S. PATENT DOCUMENTS 5,103,510 A 4/1992 Throw
11,564,498 B1 * 1/2023 Li ..... A47C 17/04
2014/0132038 A1 * 5/2014 Lu ..... A47C 1/035 297/68

FOREIGN PATENT DOCUMENTS

CN 108260984 7/2018
CN 212036846 12/2020
(Continued)

OTHER PUBLICATIONS

ISR for PCT/CN2021/130788 (Jun. 29, 2022).

*Primary Examiner* — David R Dunn
*Assistant Examiner* — Tania Abraham

(57) ABSTRACT

In a sofa seat stretching device, one end of a second support facing away from a first support, and a second leg rest plate connector are hinged at a fourth hinge point, so that the stretching assembly's stretching speed is reduced in a process of switching from a sitting position state to a lying position state when a driving assembly acts in the same way, and the weightlessness feeling can be effectively avoided. Moreover, the driving assembly drives the stretching assembly so that the process of switching the stretching assembly from the lying position state to the sitting position state is smoother.

20 Claims, 5 Drawing Sheets

(56) References Cited

FOREIGN PATENT DOCUMENTS

| | | |
|---|---|---|
| CN | 212521294 | 2/2021 |
| CN | 112716194 | 4/2021 |
| CN | 113261806 | 8/2021 |
| CN | 113317651 | 8/2021 |
| CN | 213909383 | 8/2021 |

* cited by examiner

SOFA SEAT STRETCHING DEVICE

CROSS-REFERENCE TO RELATED APPLICATION(S)

This is a national stage application filed under 37 U.S.C. 371 based on International Patent Application No. PCT/CN2021/130788, filed Nov. 16, 2021 which claims priority to a Chinese patent application No. 202111170623 filed on Oct. 8, 2021, and a Chinese patent application No. 202122414443.3 filed on Oct. 8, 2021, disclosure of which are incorporated herein by reference in its entirety.

TECHNICAL FIELD

The present application relates to the field of furniture, for example, to a sofa seat stretching device.

BACKGROUND

With the improvement of social productivity and economic level, people's expectation for a better life is growing day by day, and demand for furniture is also getting higher and higher. At present, many recliners, sofas and the like are equipped with mechanical stretching devices. In the mechanical stretching devices, backrest, seat cushion and leg rest plate are installed. To improve the convenience of operation, the mechanical stretching device is usually equipped with an electric driving assembly which is used for push the mechanical stretching device to stretch or retract so that the sofa seat has different positions to satisfy people's requirements for comfort.

To further improve people's functional requirements of the sofa seat, a sofa seat is provided. When the sofa seat is in a lying position state, legs of the user lying on the sofa seat are not lower than the heart, which alleviates the unsuitable state of the special user, so as to satisfy use requirements of the user with diseases such as hypertension and the like.

However, in a process of switching from a sitting position state to the lying position state, a sudden sense of weightlessness may occur to the user lying in the sofa seat that implements the above functions when the switching speed is too fast. Moreover, the process of switching from the lying position state to the sitting position state is not smooth, which is extremely prone to be stuck.

SUMMARY

An embodiment of the present application provides a sofa seat stretching device.

The embodiment of the present application provides a sofa seat stretching device. The device including a base and two stretching assemblies disposed on the base.

Two stretching assemblies include two backrest units, two seat frame units and two leg stretching units which are symmetrically disposed at both ends of the base in a width direction of the base, two ends of each seat frame unit are hinged to one end of one backrest unit and one end of one leg stretching unit respectively.

The driving assembly is configured to drive the two stretching assemblies to stretch or retract synchronously in a length direction of the two stretching assemblies so that the two stretching assemblies switch between a sitting position state, a TV position state, and a lying position state.

Each leg stretching unit includes a first leg rest plate connector and a second leg rest plate connector, a middle of the first leg rest plate connector and a middle of the second leg rest plate connector are hinged to a third hinge point.

Each seat frame unit includes a seat frame support hinged to one end of the second leg rest plate connector at a first hinge point, a first support, a second support and a third support. The first support, the second support and the third support are each rotatable relative to the seat frame support. One end of the third support is hinged to the seat frame support at a fifth hinge point; the other end of the third support is hinged to the first leg rest plate connector, one end of the second support is hinged to one end of the first support, the other end of the second support is hinged to the second leg rest plate connector at a fourth hinge point, the fourth hinge point is located between the first hinge point and the third hinge point, and the first hinge point is located in front of the fifth hinge point.

Each seat frame unit further includes a first connector, a second connector, a third connector, a fourth connector, a fifth connector, and a sixth connector.

One end of the first connector is hinged to the seat frame support, a middle of the first connector is hinged to one end of the third connector, the other end of the first connector is hinged to one end of the second connector, and the other end of the second connector is hinged to a front end of the base; the other end of the third connector is hinged to the one backrest unit.

One end of the fourth connector is hinged to a middle of the third support, and the other end of the fourth connector is hinged to one end of the sixth connector; a middle of the sixth connector is hinged to the seat frame support, the other end of the sixth connector is hinged to one end of the fifth connector, and the other end of the fifth connector is hinged to the middle of the second connector.

The first connector is provided with a first stopper member. The seat frame support is provided with a second stopper member for stopping a retracting of each stretching assembly and a third stopper member for stopping a stretching of each stretching assembly, and the second stopper member and the third stopper member are located at two sides of the first connector.

When the two stretching assemblies are in a lying position state, the third stopper member abuts against the first connector.

When the two stretching assemblies are in a sitting position state, the second stopper member abuts against the first connector, and the first stopper member is clamped between the seat frame support and the third support.

The second leg rest plate connector is provided with a fourth stopper member for stopping an upper end face of the first leg rest plate connector.

BRIEF DESCRIPTION OF DRAWINGS

The drawings used in description of embodiments of the present application will be briefly described below. The drawings described below merely illustrate some embodiments of the present application, and those of ordinary skill in the art may obtain other drawings based on the contents of the embodiments of the present application and these drawings on the premise that no creative work is done.

REFERENCE LIST

Figure 1:
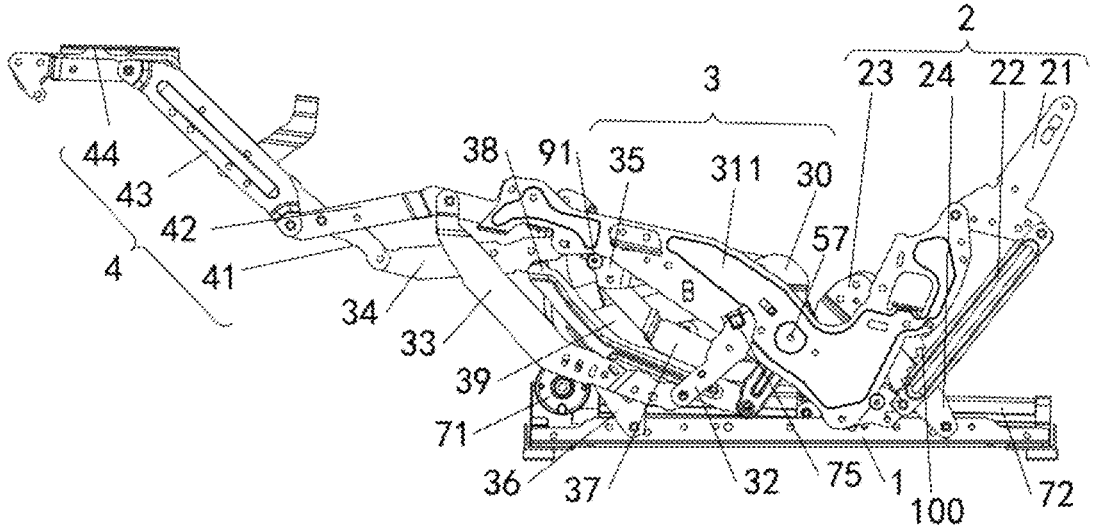
FIG. 1 is a partial structure view one of a sofa seat stretching device with a stretching assembly in a TV position provided by an embodiment of the present application.

1 base
11 front-rear connector
12 left-right connector
2 backrest unit
21 first backrest connector
22 second backrest connector
23 third backrest connector
24 fourth backrest connector
3 seat frame unit
30 sixth connector
31 seat frame support
311 first seat frame member
312 second seat frame member
32 first support
33 second support
34 third support
35 first connector
36 second connector
37 third connector
38 fourth connector
39 fifth connector;
4 leg stretching unit
41 first leg rest plate connector
42 second leg rest plate connector
43 third leg rest plate connector
44 leg rest frame;
50 tenth hinge point
51 first hinge point
52 second hinge point
53 third hinge point
54 fourth hinge point
55 fifth hinge point
56 sixth hinge point
57 seventh hinge point
58 eighth hinge point
59 ninth hinge point
61 first fixing rod
62 second fixing rod
63 third fixing rod
71 linear driving unit
72 guide rail
73 sliding block
74 drive connector
75 drive connecting rod
76 first connecting rod
77 second connecting rod
8 seat frame mounting member
91 first stopper member
92 second stopper member
93 third stopper member
94 fourth stopper member
95 fifth stopper member
100 backrest spring

DETAILED DESCRIPTION

The present application is described hereinafter through specific embodiments in conjunction the drawings. It is to be understood that the embodiments set forth below are merely intended to illustrate the present application. It is to be further noted that for convenience of description, only a part, not all, of the structures related to the embodiments of the present disclosure are shown in accompanying drawings.

Figure 2:
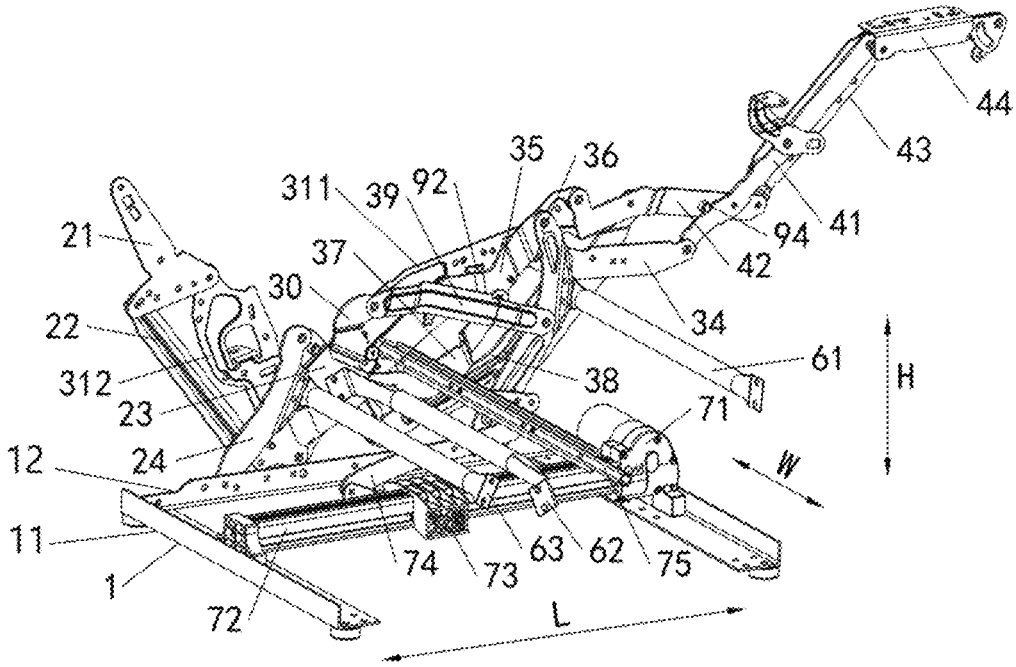
FIG. 2 is a partial structure view two of a sofa seat stretching device with a stretching assembly in a TV position provided by an embodiment of the present application.

As shown in FIGS. 1 to 9, an embodiment of the present disclosure provides a sofa seat stretching device. The device includes a base 1, a driving assembly and a stretching assembly. The driving assembly and the stretching assembly are disposed on the base 1. The stretching assembly includes backrest units 2, seat frame units 3 and leg stretching units 4 which are disposed symmetrically disposed at two sides of the base 1 in a width direction (a W direction shown in FIG. 2) of the base 1, front and rear ends of the seat frame unit 3 are hinged to one end of the backrest unit 2 and one end of the leg stretching unit 4 respectively. The front and rear ends of the seat frame unit 3 refer to both ends of the seat frame unit 3 in an L direction (a length direction) shown in FIG. 2. The front end of the seat frame unit 3 refers to an end at which the leg stretching unit 4 is located, and the rear end of the seat frame unit 3 refers to an end at which of the backrest unit 2 is located. An H direction shown in FIG. 2 is a height direction.

The driving assembly connects two seat frame units 3 through a connection unit, enabling the two stretching assemblies to be stretched and retracted synchronously along the length direction such that the stretching assembly switches between a sitting position state, a television (TV) position state and a lying position state.

The structure of the base 1 is described below.

The base 1 includes two front-rear connectors 11 and two left-right connectors 12, the two front-rear connectors 11 and the two left-right connectors 12 are connected by fasteners such as bolts to form one rectangular frame, and the base 1 serves as a support for supporting structural members connected to the base 1. In other embodiments, one rectangular frame may also be formed by welding two front-rear connectors 11 and two left-right connectors 12.

Next, a structure of the leg stretching unit 4 is described.

Figure 3:
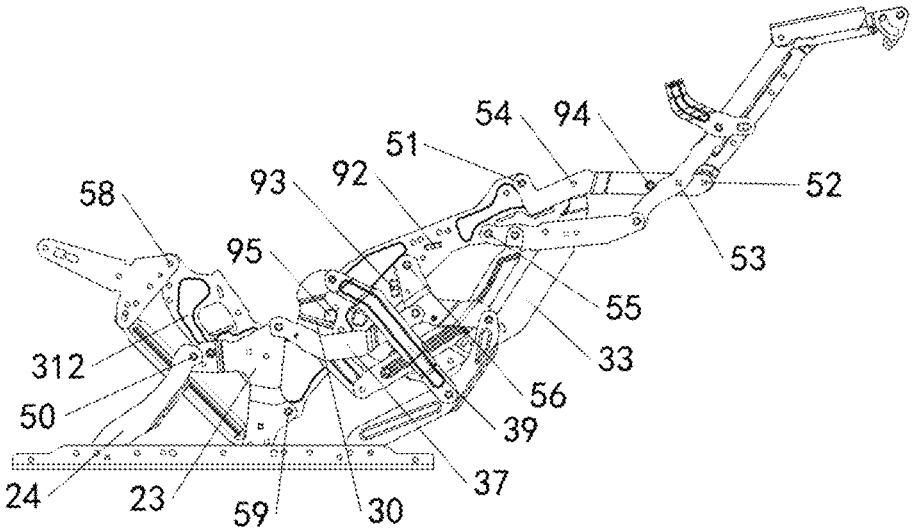
FIG. 3 is a partial structure view one of a sofa seat stretching device with a stretching assembly in a lying position provided by an embodiment of the present application.

Referring to FIGS. 2 and 3, the leg stretching unit 4 includes a first leg rest plate connector 41, a second leg rest plate connector 42, a third leg rest plate connector 43 and a leg rest plate frame 44. One end of the first leg rest plate connector 41 is hinged to the seat frame unit 3, one end of the second leg rest plate connector 42 is hinged to a front end of the seat frame unit 3 at a first hinge point 51, the other end of the second leg rest plate connector 42 is hinged to one end of the third leg rest plate connector 43 at a second hinge point 52, each of the other end of the first leg rest plate connector 41 and the other end of the third leg rest plate connector 43 is hinged to the leg rest plate frame 44, the first leg rest plate connector 41 is parallel to the third leg rest plate connector 43, and a middle of the first leg rest plate connector 41 is hinged to a middle of the second leg rest plate connector 42 at a third hinge point 53. The second leg rest plate connector 42 is provided with a fourth stopper member 94 for stopping an upper end surface of the first leg rest plate connector 41. The first hinge point 51, the fourth stopper member 94, the third hinge point 53, and the second hinge point 52 are distributed sequentially in an extending direction of the second leg rest plate connector 42.

Next, a structure of the seat frame unit 3 is described.

Referring to FIGS. 1, 2, 3 and 6, the seat frame unit 3 includes a seat frame support 31, a first support 32, a second support 33, and a third support 34. The two seat frame units 3 are connected by a drive connecting rod 75. Two axial ends of the drive connecting rod 75 pass through the two seat frame units 3 and are fixedly connected to one end of the two first supports 32 so that the first support 32 is rotatable relative to the seat frame support 31. The other end of the first support 32 is hinged to one end of the second support 33, the other end of the second support 33 is hinged to the middle of the second leg rest plate connector 42 at a fourth hinge point 54, one end of the second leg rest plate connector 42 facing away from the third leg rest plate connector 43 is hinged to the seat frame support 31 at the first hinge point 51, and the fourth hinge point 54 is located between the first hinge point 51 and the fourth stopper member 94. One end of the third support 34 is hinged to one end of the first leg rest plate connector 41, and the other end of the third support 34 is hinged to the seat frame support 31 at the fifth hinge point 55.

Figure 4:
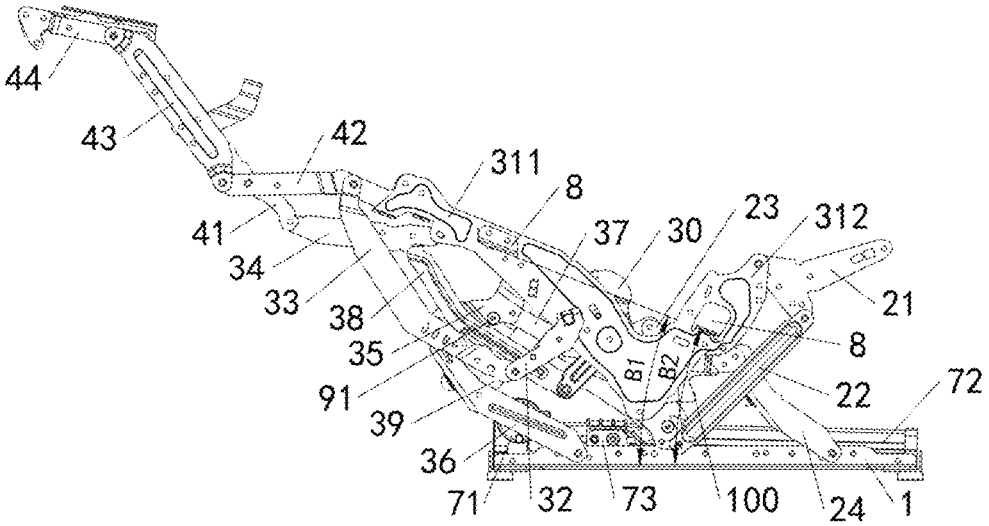
FIG. 4 is a partial structure view two of a sofa seat stretching device with a stretching assembly in a lying position provided by an embodiment of the present application.
Figure 5:
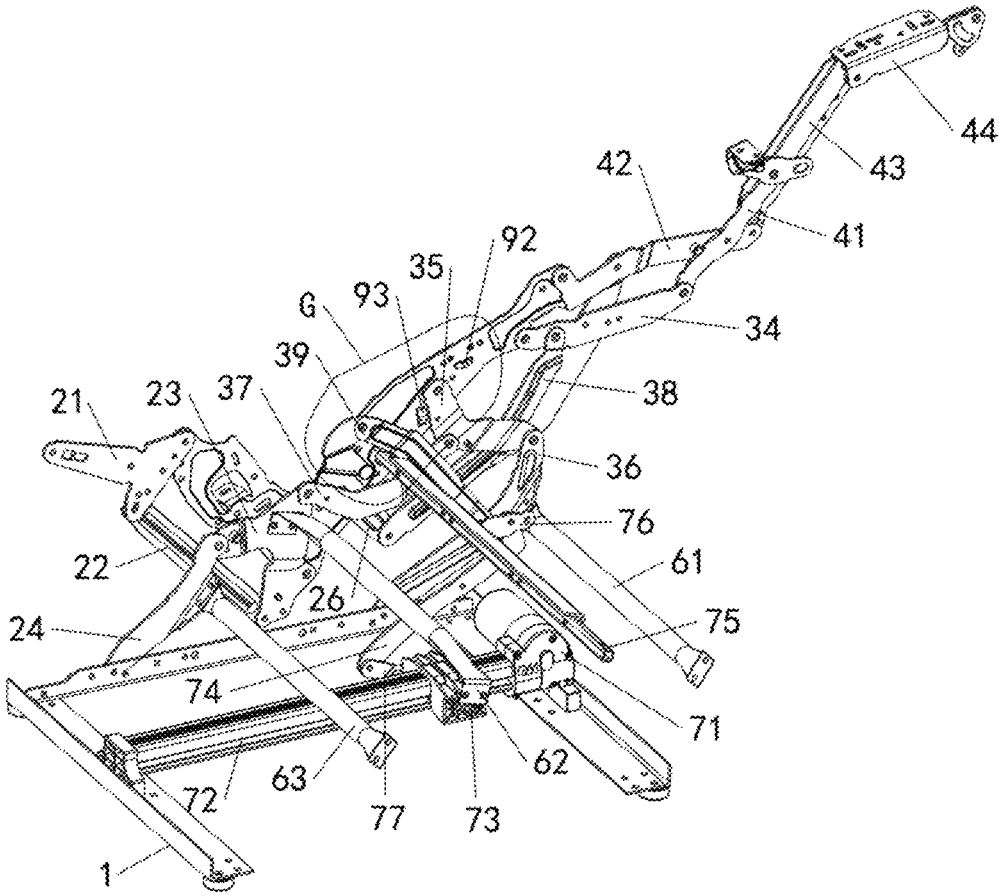
FIG. 5 is a partial structure view three of a sofa seat stretching device with a stretching assembly in a lying position provided by an embodiment of the present application.

Referring to FIGS. 1, 3 and 5, the seat frame unit 3 further includes a first connector 35, a second connector 36, a third connector 37, a fourth connector 38, a fifth connector 39 and a sixth connector 30. One end of the first connector 35 is hinged to the seat frame support 31 at a sixth hinge point 56, a middle of the first connector 35 is hinged to one end of the third connector 37, the other end of the first connector 35 is hinged to one end of the second connector 36, and the other end of the second connector 36 is hinged to a front end of the left-right connector 12; and the other end of the third connector 37 is hinged to the backrest unit 2. Referring to FIGS. 3 and 4, one end of the fourth connector 38 is hinged to a middle of the third support 34, the other end of the fourth connector 38 is hinged to one end of the sixth connector 30, a middle of the sixth connector 30 is hinged to the seat frame support 31 at a seventh hinge point 57, the other end of the sixth connector 30 is hinged to one end of the fifth connector 39, and the other end of the fifth connector 39 is hinged to the middle of the second connector 36.

Next, a structure of the backrest unit 2 is described.

Referring to FIGS. 1 and 3, the backrest unit 2 includes a first backrest connector 21, a second backrest connector 22, a third backrest connector 23, and a fourth backrest connector 24. One end of a lower part of the first backrest connector 21 is hinged to one end of the second backrest connector 22, the other end of the lower part of the first backrest connector 21 is hinged to the seat frame support 31 at an eighth hinge point 58, the third backrest connector 23 is in a substantially V-shaped structure, one end portion of the third backrest connector 23 is hinged to the other end of the second backrest connector 22, a middle of the third backrest connector 23 is hinged to one end of the third connector 37, the other end portion of the third backrest connector 23 is hinged to one end of the fourth backrest connector 24 at a tenth hinge point 50, the third backrest connector 23 is hinged to the seat frame support 31 at a ninth hinge point 59, the ninth hinge point 59 is located between the other end of the third backrest connector 23 and the middle of the third backrest connector 23, the other end of the fourth backrest connector 24 is hinged to a rear end of the left-right connector 12, referring to FIG. 4, a backrest spring 100 is connected near a hinge point of the third backrest connector 23 and the second backrest connector 22, and the other end of the backrest spring 100 is connected to the seat frame support 31.

In this embodiment, referring to FIGS. 1 and 2, the seat frame support 31 includes a first seat frame member 311 and a second seat frame member 312, a lower end of the first seat frame member 311 and a lower end of the second seat frame member 312 are connected to form the seat frame support 31 which is in a shape of "Ai". Referring to FIG. 3, the first hinge point 51, the fifth hinge point 55, the sixth hinge point 56 are located on the first seat frame member 311, and are distributed in a direction from the first seat frame member 311 to the second seat frame member 312 sequentially, the eighth hinge point 58 is located at a free end of the second seat frame member 312, the ninth hinge point 59 is located at a connection position of the first seat frame member 311 and the second seat frame member 312, that is, at a turning position of the "√"-shaped structure. Referring to FIG. 4, the other end of the backrest spring 100 is connected to a middle position of the second seat frame member 312.

Figure 9:
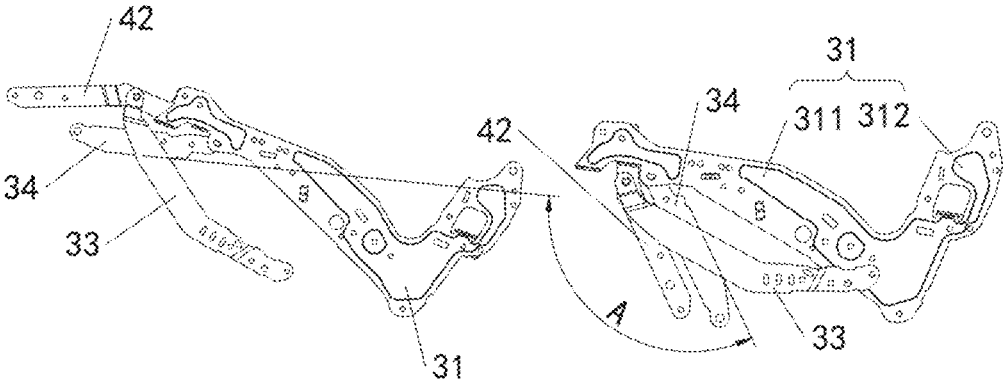
FIG. 9 is a view illustrating a position relationship between a third support when the stretching assembly is in the sitting position and the third support when the stretching assembly is in the lying position provided by an embodiment of the present application.

As shown in FIG. 9, an included angle between a surface of the third support 34 facing a lateral surface of the base 1 when the two stretching assemblies are in the sitting position state, and a rear lateral surface of the third support 34 when the two stretching assemblies are in the lying position state is A; and the tenth hinge point 50 is always located below the middle position of the second seat frame member 312 during the stretching or retracting process of the two stretching assemblies such that $100° \leq A \leq 110°$. In an embodiment, A may be 100°, 101°, 102°, 103°, 104°, 105°, 106°, 107°, 108°, 109° and 110°. Exemplarily, A=106°. A position of the tenth hinge point 50 is limited, a magnitude of A is adjusted so that the position of the tenth hinge point 50 is much lower, that is, a stretching distance of the third backrest connector 23 and the fourth backrest connector 24 is shorter, the smoothness of the stretching or retracting of the stretching assembly is improved so that when the stretching assembly is in the lying position, the zero-gravity feeling of the user lying on the sofa seat is obvious.

As shown in FIG. 1, a first fixing rod 61 is provided between two second connectors 36 on left and right sides of the base 1, a second fixing rod 62 is provided between two third backrest connectors 23 on the left and right sides of the base 1, and a third fixing rod 63 is provided between two fourth backrest connectors 24 on the left and right sides of the base 1.

Referring to FIGS. 2 and 5, the driving assembly includes a linear drive unit 71 (for example, the linear drive unit 71 may be an electric driver), a guide rail 72 and a connecting unit which are arranged on the base 1. Exemplarily, the linear drive unit 71 is a linear motor. A sliding block 73 is slidably arranged on the guide rail 72, and an output end of the linear drive unit 71 is connected to the sliding block 73. The connection unit includes the drive connecting rod 75 and a drive connector 74. Two ends of the drive connector 74 are hinged to a first connecting rod 76 and a second connecting rod 77 respectively, the first connecting rod 76 is fixedly connected to the drive connecting rod 75 and the second connecting rod 77 is fixedly connected to the sliding block 73. The two ends of the drive connecting rod 75 are connected to the first supports 32 of the seat frame units 3 on the left and right sides. The linear drive unit 71 drives the sliding block 73 to move back and forth along the guide rail 72 so as to drive the stretching assembly to stretch or retract. Exemplarily, the linear drive unit 71 is the linear motor. A fixed end of the linear drive unit 71 is mounted on the front-rear connector 11, and a guide rail 72 is located between the two left-right connectors 12. The front and rear ends of the guide rail 72 are fixedly connected to the two front-rear connectors 11 respectively and the guide rail 72 is arranged to be parallel to the left-right connector 12.

Referring to FIG. 3, the seat frame support 31 is provided with a third stopper member 93 for stopping the stretching of the stretching assembly, for example, the third stopper member 93 is used for stopping a moving position of the first connector 35. The seat frame support 31 is further provided with a second stopper member 92 for stopping the retracting of the stretching assembly. For example, the second stopper member 92 is used for stopping a movement of the first connector 35. The sixth hinge point 56 is located between the second stopper member 92 and the third stopper member 93. In this embodiment, referring to FIGS. 1 and 3, the seventh hinge point 57 is located between the ninth hinge point 59 and the third stopper member 93.

Figure 6:
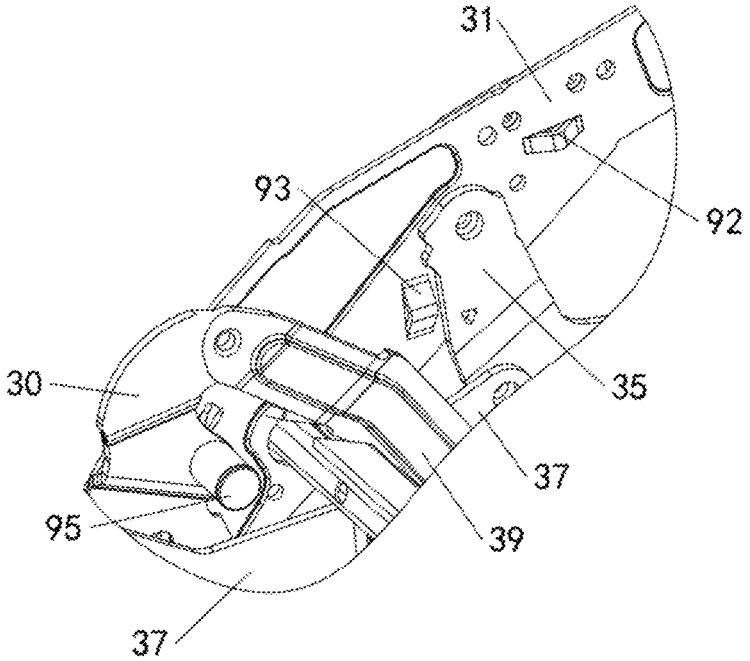
FIG. 6 is a partial enlarged view illustrating a part G in FIG. 5 of the present application.

In this embodiment, referring to FIGS. 5 and 6, the seat frame support 31, the third support 34, the fourth connector 38 and the sixth connector 30 form a four-link mechanism. Referring to FIG. 4, the second seat frame member 312, the second backrest connector 22, the third backrest connector 23 and the first backrest connector 21 form a four-link mechanism. Referring to FIGS. 4 and 6, the seat frame support 31, the third support 34, the second leg rest plate connector 42 and the first leg rest plate connector 41 constitute a four-link mechanism.

Figure 7:
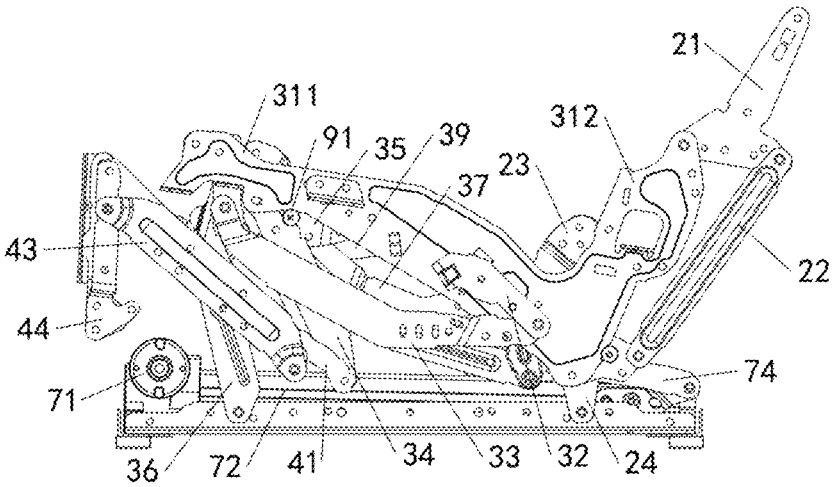
FIG. 7 is a partial structure view one of a sofa seat stretching device with a stretching assembly in a sitting position provided by an embodiment of the present application.
Figure 8:
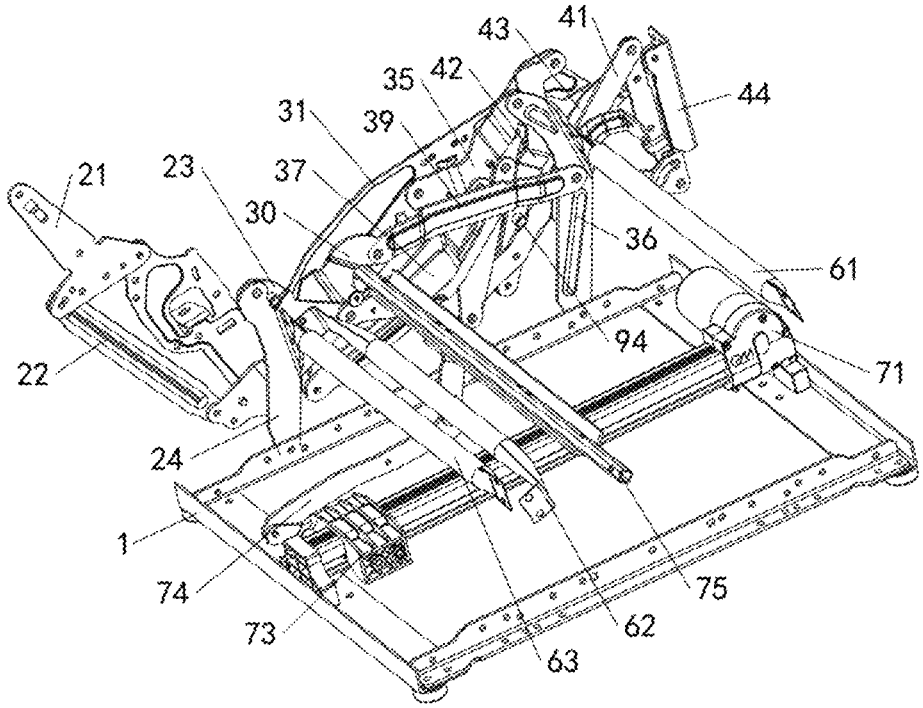
FIG. 8 is a partial structure view two of a sofa seat stretching device with a stretching assembly in a sitting position provided by an embodiment of the present application.

Referring to FIG. 5, the linear drive unit 71 drives the sliding block 73 to slide backward and forward on the guide rail 72. The sliding block 73 drives, through the driving the drive connector 74, the first connecting rod 76 and the second connecting rod 77, the drive connecting rod 75 to move back and forth, then the drive connecting rod 75 drives the seat frame support 31 and the first support 32 on the left and right sides to move synchronously, and the seat frame support 31 and the first support 32 drives the stretching assembly to stretch or retract. When the stretching assembly is stretched, the stretching assembly changes from the sitting position to the TV position to the lying position sequentially; and when the stretching assembly is retracted, the stretching assembly changes from the lying position to the TV position to the sitting position sequentially. Referring to FIG. 7, the first connector 35 is provided with a first stopper member 91 for stopping a movement of the third support 34. When the stretching assembly is in a sitting position state, the sliding block 73 moves to a side of the backrest unit 2, the first stopper member 91 is clamped to a lower lateral surface of the seat frame support 31 and an upper lateral surface of the third support 34, the second stopper member 92 is a safety stopper, thereby the stretching assembly is restricted from continuing to move to the side of the backrest unit 2 (the first stopper member 91 and the second stopper member 92 may be used for preventing the seat frame support 31 from collapsing when a person sits on a sofa, and when the first stopper member 91 and the second stopper member 92 just come into contact with a part to be stopped, the seat is retracted to be in a tightest state), and at this time, the linear drive unit 71 stops working, that is, the stretching assembly remains a stable sitting position state. As shown in FIG. 3, the sixth connector 30 is provided with a fifth stopper member 95 for stopping movements of the third connector 37 and the third backrest connector 23. When the stretching assembly is in the sitting position state, the fifth stopper member 95 abuts against the upper lateral surface of the third connector 37 and an upper lateral surface of the third backrest connector 23.

When the stretching assembly is stretched, the linear drive unit 71 drives the sliding block 73 to move toward a side of the leg stretching unit 4. The sliding block 73 drives, through the drive connector 74, the first connecting rod 76 and the second connecting rod 77, the drive connecting rod 75 to move back and forth. The drive connecting rod 75 drives the first support 32, the first support 32 drives the second support 33 and the second support 33 pushes the second leg rest plate connector 42 to stretch toward the front end of the seat frame unit 3. The second leg rest plate connector 42 pushes the first leg rest plate connector 41 and the third leg rest plate connector 43 at a same time until the leg stretching unit 4 is fully stretched to complete the conversion from the sitting position to the TV position. The stretching of the leg stretching unit 4 only requires one force transmission performed by the second leg rest plate connector 42. The transmission process has extremely small loss, so that the stretching assembly can operate smoothly and the energy is saved.

When the stretching assembly needs to be stretched continuously, the linear drive unit 71 drives the sliding block 73 to move toward the side of the leg stretching unit 4. In this case, the first stopper member 91 fails to stop the third support 34. When the stretching assembly stretches to the TV position state, the first stopper member 91 is located on the lower lateral surface of the seat frame support 31, and the second stopper member 92 is the safety stopper. In this case, the first stopper member 91 and the second stopper member 92 work together so that the support 31 and the first connector 35 are in a relatively stationary and stable state, avoiding the seat frame unit from collapsing. Under an action of the drive connecting rod 75, the first fixing rod 61, the second fixing rod 62, the third fixing rod 63, the first stopper member 91 and the second stopper member 92, the stretching assembly can remain in the TV position state. When the linear drive unit 71 continues to drive the sliding block 73 toward the side of the leg stretching unit 4, the first connector 35 moves downward, disengages the stopping action of the second stopper member 92 and moves to a position where the first connector 35 comes into contact with the third stopper member 93, the third stopper member 93 is fully clamped to the lower lateral surface of the first connector 35, in this case, the stretching assembly reaches a stable lying position state. When the stretching assembly is retracted, the stretching assembly can sequentially move in reverse.

The first stopper member 91 is configured as a columnar structure. When the seat frame support 31 and the third support 34 are simultaneously stopped, the first stopper member 91 can adapt different angles of stress and play a role of stably stopping. The fourth stopper member 94 is configured as a columnar structure which is convenient to adapt to stop the first leg rest plate connector 41 from different angles. The fifth stopper member 95 is configured as a columnar structure to facilitate the stopping of the third connector 37 and the third backrest connector 23 at the same time.

Each of the second stopper member 92 and the third stopper member 93 adopts a V-shaped stopper projection, and the V-shaped stopper projection is integrally formed with the seat frame support 31. A lateral surface of the V-shaped stopper projection is a plane and can adapt to an edge of the first connector 35, so that the stopping can be more stable and less susceptible to shaking and deformation.

Compared with the related art in which one end of the second support 33 facing away from the first support 32 is hinged to the middle of the third support, in this embodiment, one end of the second support 33 facing away from the first support 32 is hinged to the second leg rest connector 42 at the fourth hinge point 54, so that when the sliding block moves a same distance, the stretching assembly's stretching speed is reduced in a process of switching from a sifting position state to a lying position state. Reducing the switching speed of switching from the sifting position state to the lying position state can effectively avoid the weightlessness. Moreover, the driving assembly drives the stretching assembly to act so that the process of switching the stretching assembly from the lying position state to the sifting position state is smoother.

Referring to FIG. 4, a backrest spring 100 has a telescopic length of a1 when the stretching assembly is in the sifting position state and the TV position state, and the backrest spring 100 has a telescopic length of a2 when the stretching assembly is in the lying position state, and a ratio of a1 to a2 ranges from 0.7 to 0.9. In this embodiment, the stretching assembly is provided with the backrest spring 100, a1:a2=0.84. In the sitting position state, a length of the backrest spring 100 is 105.22 mm. When the stretching assembly is stretched, the leg stretching unit 4 is stretched first, and then the seat frame unit 2 is rotated. When the stretching assembly is stretched to the lying position state, the backrest spring 100 is stretched to a maximum length, in this case, the length is 125.02 mm. When the stretching assembly is retracted, the backrest unit 2 is rotated back first, and then the leg stretching unit 4 is retracted. In the retracting process, a contractile force of the backrest spring 100 makes the retracting process natural and smooth, and the retracting process is much easier.

In one embodiment, referring to FIG. 4, two seat frame mounting members 8 are arranged on an outer side of the seat frame support 31 for mounting a cushion. In this embodiment, one seat frame mounting member 8 is disposed on each of an outer side of the first seat frame member 311 and an outer side of the second seat frame member 312; and angles between lower lateral surfaces of the two seat frame mounting members 8 on a same seat frame support 31 and the base 1 are B1 and B2 respectively, referring to FIG. 4, when the two stretching assembly is in the lying position state, values of B1 and B2 range from 13° to 23°. The stretching assembly conforms to the ergonomic structure, so that the lying position is flatter and reaches a posture of zero gravity of the human body, that is, the stretching assembly is more comfortable.

The characteristics of various embodiments of the present application are as follows.

Compared with the related art in which one end of the second support facing away from the first support is hinged to the middle of the third support, in the sofa seat stretching device provided by the embodiment of the present application, one end of the second support facing away from the first support is hinged to the second leg rest plate connector at the fourth hinge point, so that the stretching assembly's stretching speed is reduced in the process of switching from the sitting position state to the lying position state when the driving assembly acts in the same way, and the weightlessness feeling can be effectively avoided. Moreover, the driving assembly drives the stretching assembly to act so that the process of switching the stretching assembly from the lying position state to the sitting position state is smoother.

When the stretching assembly is in different states, the fourth stopper member 94 functions as a stopper for the first leg rest plate connector 41 to improve the stability of the stretching assembly in different states.

When the stretching assembly is in the sitting position state, the first stopper member 91 is clamped between the seat frame support 31 and the third support 34, and the second stopper 92 serves as the safety stopper to restrict the stretching assembly from continuing to move toward a side where the backrest unit 2 is located, so that the stretching assembly stably remains in the sitting position state when the driving assembly stops acting.

When the stretching assembly is in the lying position state, the third stopper member 93 is clamped on the lower lateral surface of the first connector 35 to support and stop the first connector 35, so that the stretching assembly stably remains in the lying position state.

For those of ordinary skill in the art, changes or alterations in other different forms may also be made based on the preceding description. Implementations of the present disclosure cannot be and do not need to be all exhausted herein.

In the description of the present application, it is to be noted that the orientations or position relations indicated by terms such as "center", "above", "below", "left", "right", "vertical", "horizontal", "inside", "outside", and the like are based on orientations or position relations shown in the drawings. These orientations or position relations are intended only to facilitate and simplify the description of the present application and not to indicate or imply that an apparatus or element referred to must have such specific orientations or must be configured or operated in such specific orientations. Thus, these orientations or position relations are not to be construed as stopping the present application. In addition, terms such as "first" and "second" are used merely for the purpose of description and are not to be construed as indicating or implying relative importance. For example, the terms "first position" and "second position" are two different positions.

For example, a direction in which a leg (or the leg stretching unit 4) extends outward may be defined as a front (the front end), and a direction in which a backrest (or the backrest unit 2) extends may be defined as a rear (the rear end). For another example, a direction between the leg (or the leg stretching unit 4) and the backrest (or the backrest unit 2) may be defined as a length direction (the L direction, the front-back direction), a direction horizontally perpendicular to the front-back direction may be defined as a width direction (the W direction) of the base 1, and a direction perpendicular to the L direction and the W direction may be defined as a height direction (an H direction).

In the description of the present application, it is to be noted that unless otherwise expressly specified and limited, the term "mounted", "connected to each other" or "connected" should be construed in a broad sense as securely connected, detachably connected or integrally connected; mechanically connected or electrically connected; directly connected to each other or indirectly connected to each other via an intermediary; or intraconnected between two components. For those of ordinary skill in the art, specific meanings of the preceding terms in the present application may be understood based on specific situations.

What is claimed is:

1. A sofa seat stretching device, comprising a base, two stretching assemblies and a driving assembly, wherein the two stretching assemblies and the driving assembly are disposed on the base, wherein two stretching assemblies comprise two backrest units, two seat frame units and two leg stretching units, wherein the two backrest units, the two seat frame units and the two leg stretching units are symmetrically disposed at both ends of the base in a width direction of the base, two ends of each of the two seat frame units are hinged to one end of one backrest unit of the two backrest units, and one end of one leg stretching unit of the two leg stretching units respectively;

the driving assembly is configured to drive the two stretching assemblies to stretch or retract synchronously in a length direction of the two stretching assemblies so that the two stretching assemblies switch between a sitting position state, a TV position state, and a lying position state, wherein each of the two leg stretching units comprises a first leg rest plate connector and a second leg rest plate connector, a middle of the first leg rest plate connector and a middle of the second leg rest plate connector are hinged to a third hinge point;

each of the two seat frame units-comprises a seat frame support, a first support, a second support and a third support, wherein the seat frame support is hinged to one end of the second leg rest plate connector at a first hinge point, the first support, the second support and the third support are each rotatable relative to the seat frame support, one end of the third support is hinged to the seat frame support at a fifth hinge point; the other end of the third support is hinged to the first leg rest plate connector, one end of the second support is hinged to one end of the first support, the other end of the second support is hinged to the second leg rest plate connector at a fourth hinge point, the fourth hinge point is located between the first hinge point and the third hinge point, and the first hinge point is located in front of the fifth hinge point;

each of the two seat frame units-further comprises a first connector, a second connector, a third connector, a fourth connector, a fifth connector, and a sixth connector;

one end of the first connector is hinged to the seat frame support, a middle of the first connector is hinged to one end of the third connector, the other end of the first connector is hinged to one end of the second connector, and the other end of the second connector is hinged to a front end of the base; the other end of the third connector is hinged to the one of the two backrest units;

one end of the fourth connector is hinged to a middle of the third support, and the other end of the fourth connector is hinged to one end of the sixth connector; a middle of the sixth connector is hinged to the seat frame support, the other end of the sixth connector is hinged to one end of the fifth connector, and the other end of the fifth connector is hinged to the middle of the second connector;

the first connector is provided with a first stopper member for stopping a movement of the third support, the seat frame support is provided with a second stopper member for stopping a retracting of each of the two stretching assemblies, and a third stopper member for stopping a stretching of each of the two stretching assemblies, and the second stopper member and the third stopper member are located at two sides of the first connector;

when the two stretching assemblies are in a lying position state, the third stopper member abuts against the first connector;

when the two stretching assemblies are in a sitting position state, the second stopper member abuts against the first connector, and the first stopper member is clamped between the seat frame support and the third support; and the second leg rest plate connector is provided with a fourth stopper member for stopping an upper end surface of the first leg rest plate connector.

2. The sofa seat stretching device of claim 1, wherein each of the two backrest units comprises a first backrest connector, a second backrest connector, a third backrest connector and a fourth backrest connector; and one end of a lower part of the first backrest connector is hinged to one end of the second backrest connector, and the other end of the lower part of the first backrest connector is hinged to the seat frame support; one end portion of the third backrest connector is hinged to the other end of the second backrest connector, the middle of the third backrest connector is hinged to one end of the third connector, the other end portion of the third backrest connector is hinged to one end of the fourth backrest connector at a tenth hinge point, the third backrest connector is hinged to the seat frame support, and the other end of the fourth backrest connector is hinged to a rear end of the base.

3. The sofa seat stretching device of claim 2, wherein the third backrest connector and the seat frame support are connected by a backrest spring, the backrest spring has a telescopic length of a1 when the two stretching assemblies are in a sitting position state and a TV position state, and the backrest spring has a telescopic length of a2 when the two stretching assemblies are in a lying position state, and a ratio of a1 to a2 ranges from 0.7 to 0.9.

4. The sofa seat stretching device of claim 3, wherein the seat frame support comprises a first seat frame member of which one end is connected to each of the two leg stretching units, and a second seat frame member, of which one end is connected to each of the two backrest units, and the other end of the first seat frame member is connected to the other end of the second seat frame member to form the seat frame support which is in a shape of an L; one end of the backrest spring is connected to the third backrest connector, and the other end of the backrest spring is connected to a middle position of the second seat frame member.

5. The sofa seat stretching device of claim 4, wherein an included angle between a surface of the third support facing a lateral surface of the base when the two stretching assemblies are in the sitting position state, and a rear lateral surface of the third support when the two stretching assemblies are in the lying position state is A; and the tenth hinge point is always located below the middle position of the second seat frame member during the stretching or retracting process of the two stretching assemblies such that $100° \leq A \leq 110°$.

6. The sofa seat stretching device of claim 5, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

7. The sofa seat stretching device of claim 4, wherein two seat frame mounting members are disposed on an outer side of the first seat frame member and an outer side of the second seat frame member separately; and angles between lower lateral surfaces of the two seat frame mounting members on a same seat frame support and the base are B1 and B2 respectively, when the two stretching assemblies are in the lying position state, values of B1 and B2 range from 13° to 23°.

8. The sofa seat stretching device of claim 7, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

9. The sofa seat stretching device of claim 4, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

10. The sofa seat stretching device of claim 3, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

11. The sofa seat stretching device of claim 2, wherein a sixth connector is provided with a fifth stopper member for stopping movements of the third connector and the third backrest connector; and when the two stretching assemblies are in the sitting position state, the fifth stopper member abuts against an upper lateral surface of the third connector and an upper lateral surface of the third backrest connector.

12. The sofa seat stretching device of claim 11, wherein each of the second stopper member and the third stopper member is configured as a V-shaped stopper projection, and the V-shaped stopper projection is integrally formed with the seat frame support; and each of the fourth stopper member, the first stopper member and the fifth stopper member are arranged in a columnar structure.

13. The sofa seat stretching device of claim 12, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

14. The sofa seat stretching device of claim 11, wherein the second stopper member and the third stopper member are configured as V-shaped stopper projections respectively, and the V-shaped stopper projections are integrally formed with the seat frame support.

15. The sofa seat stretching device of claim 11, wherein each of the fourth stopper member, the first stopper member and the fifth stopper member are arranged in the columnar structure.

16. The sofa seat stretching device of claim 11, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

17. The sofa seat stretching device of claim 1, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

18. The sofa seat stretching device of claim 1, wherein the first hinge point, the fourth hinge point, the fourth stopper member and the third hinge point are distributed sequentially in an extending direction of the second leg rest plate connector.

19. The sofa seat stretching device of claim 2, wherein the driving assembly comprises a guide rail and a linear drive unit which are fixed on the base, wherein the guide rail is provided with a sliding block slidably connected to the guide rail in a front-back direction, and the sliding block is connected to the third support of the two seat frame units through a connection unit; and a linear drive unit which is fixed on the base, wherein an output terminal of the linear drive unit is fixedly connected to the sliding block.

20. The sofa seat stretching device of claim 2, wherein the first hinge point, the fourth hinge point, the fourth stopper member and the third hinge point are distributed sequentially in an extending direction of the second leg rest plate connector.

* * * * *